US009032681B1

(12) United States Patent
Brady

(10) Patent No.: US 9,032,681 B1
(45) Date of Patent: May 19, 2015

(54) BUILDING CONSTRUCTION SYSTEM

(71) Applicant: Todd A. Brady, Beverly Hills, CA (US)

(72) Inventor: Todd A. Brady, Beverly Hills, CA (US)

( * ) Notice: Subject to any disclaimer, the term of this patent is extended or adjusted under 35 U.S.C. 154(b) by 0 days.

(21) Appl. No.: 14/263,833

(22) Filed: Apr. 28, 2014

(51) Int. Cl.

| | |
|---|---|
| ***E04B 1/18*** | (2006.01) |
| ***E02C 3/00*** | (2006.01) |
| ***E04B 1/19*** | (2006.01) |
| ***E04B 1/41*** | (2006.01) |

(52) U.S. Cl.
CPC ..... *E02C 3/00* (2013.01); *E04B 1/1903* (2013.01); *E04B 1/185* (2013.01); *E04B 2001/1993* (2013.01); *E04B 1/41* (2013.01)

(58) Field of Classification Search
CPC ..... E04B 1/4107; E04B 1/41; E04B 1/215; E04B 2001/2415; E04B 2/96; E04B 2/825; E04B 2/885; E04B 2005/322; E04B 2005/324; E04B 2005/173; E04B 2005/176; E04B 9/30; E04C 3/07
See application file for complete search history.

(56) References Cited

U.S. PATENT DOCUMENTS

| | | | | |
|---|---|---|---|---|
| 1,899,454 | A | 2/1933 | Bemis | |
| 2,270,672 | A | 1/1942 | Hereen | |
| 2,896,299 | A | 7/1959 | Hemb | |
| 5,720,571 | A * | 2/1998 | Frobosilo et al. | 403/403 |
| 5,846,018 | A * | 12/1998 | Frobosilo et al. | 403/403 |
| 6,213,679 | B1 * | 4/2001 | Frobosilo et al. | 403/403 |
| 6,591,562 | B2 * | 7/2003 | Ting | 52/235 |
| 7,104,024 | B1 * | 9/2006 | diGirolamo et al. | 52/710 |
| 7,503,150 | B1 * | 3/2009 | diGirolamo et al. | 52/702 |
| 8,011,144 | B2 | 9/2011 | Compton | |
| 8,511,032 | B2 * | 8/2013 | Abdel-Rahman et al. | 52/655.1 |
| 8,555,592 | B2 * | 10/2013 | Daudet et al. | 52/489.1 |
| 2006/0032180 | A1 * | 2/2006 | Peterson | 52/712 |
| 2008/0222981 | A1 * | 9/2008 | De Gobbi | 52/235 |
| 2010/0257812 | A1 * | 10/2010 | Schultz et al. | 52/704 |
| 2012/0210658 | A1 * | 8/2012 | Logan | 52/173.1 |
| 2014/0157718 | A1 * | 6/2014 | Fournier et al. | 52/707 |

* cited by examiner

*Primary Examiner* — Christine T Cajilig
(74) *Attorney, Agent, or Firm* — Trojan Law Offices

(57) ABSTRACT

A building construction system is provided having an elongated track (bypass clip track) that overlays a front edge of a concrete slab. The elongated track provides an even flat surface along an uneven concrete slab because the elongated track can be placed at adjustable distances from slab edges that may be uneven. The track is secured to a bracketing structure that has foam inserts that become embedded within the top and/or bottom surface of the concrete slab after the concrete hardens. By attaching the track to these foam inserts instead of the concrete directly, breakage or spalling of the slab edge is reduced. Studs are then attached to a stud attachment plate extending from the track, such that thereafter, a wall or façade may be attached to the track that overlays the uneven slab edge.

6 Claims, 11 Drawing Sheets

BUILDING CONSTRUCTION SYSTEM

CROSS-REFERENCE TO RELATED APPLICATIONS

None

BACKGROUND OF THE INVENTION

1. Field of the Invention

This invention relates to a building construction, and more particularly, to a bracketing system for creating an even secondary edge along an uneven slab edge for attaching studs.

2. Background Information

Concrete slabs form a part of the load bearing structure of buildings and are used to support non-load bearing walls. In designing the edge of the slab, there are two typical approaches: the slab cantilevers over the spandrel beam and loads are applied to the overhang, or loads are carried by a structural steel plate or assembly attached to a spandrel beam. Furthermore, a slab must also have sufficient strength to carry a load without increasing the thickness of the floor slab system. If the slab does not have sufficient strength, a bent plate or other steel assembly must be designed to transfer loads to a spandrel beam.

One situation that occurs when creating a concrete slab is that the edge of the slab may be formed unevenly. This often occurs because a margin of error from ¼inch to 2 inches is considered acceptable when the framing for the slab is constructed before the concrete is poured. This imprecision results in an uneven slab edge.

The precision required to build the load bearing structures of a building is less precise than what is needed to construct internal non-load bearing walls that support, for example, dry wall. Construction workers building the load bearing structures that support concrete slabs in a multi-story building are not focused on making every slab edge perfectly straight. Even when done carefully, the edges of the slab usually do not line up perfectly due to the imprecision of the multiple slabs placed adjacent to each other. If studs and walls are installed on an uneven slab edge, then the result is a crooked wall. As a consequence, it is necessary to install intermediary components that compensate for the uneven slab edge in order for the non-load bearing walls to be straight and true. Although secondary structures can be used to cover an uneven slab edge to create an even surface, often these secondary attachment structures may cause the slab edge to break or cause spalling. The present invention provides a novel solution for this problem by providing a system and method for evenly attaching studs to an uneven slab edge while preventing the problem of slab edge breakage or spalling.

SUMMARY OF THE INVENTION

The present invention is directed to a building construction system that allows for adjustably connecting building components. The present invention is directed toward forming an even surface along an uneven slab edge, and for securely attaching this structure to a slab edge without causing any breakage or spalling.

It is a purpose of the present invention is to provide a building construction system for adaptable on-site installation of structures that allow for a straight even surfaced elongated track to attach to other structures embedded within a concrete slab in order to create a secondary surface for attaching studs, walls, facades, and the like.

It is another purpose of the present invention to have elements of the building construction system provide means to secure the system to the slab edge without breaking the slab edge by attaching the system to foam inserts embedded within the concrete slab instead of attaching the system directly to the slab. By having the building construction system attached to foam inserts, and not concrete, the occurrence of breakage, chipping, and spalling on the slab is is reduced when the straight track is placed over the uneven slab edge.

The building system comprises a bent plate (or pour stop), a screw pocket bracket, a foam insert within the screw pocket bracket, and an elongated track (or bypass clip track). The bent plate has two regions that are perpendicular to each other. The first region of the bent plate can be secured to a spandrel beam for support, and is adjacent to the bottom surface of the slab. The second region of the bent plate is substantially perpendicular to the first region, thereby forming an L-shaped plate. Attached to the bent plate is a screw pocket bracket. The screw pocket bracket has a screw pocket plate, a screw pocket flange extending substantially perpendicular from the screw pocket plate, and a screw pocket lip extending substantially perpendicular from the screw pocket flange. The screw pocket plate, flange, and lip, form the outer boundaries of a screw pocket internal channel or pocket. Disposed within this internal channel is a foam insert that becomes embedded within the top surface of a concrete slab.

When wet concrete is poured into a metal deck to form a slab, the concrete fills the deck, but is prevented from filling the entirety of the screw pocket internal channel due to the presence of the foam insert, which is located near the top front edge of the concrete slab. As the concrete hardens, it hardens around the foam insert along the front edge of the concrete slab, providing a region along the top and/or bottom surface of the slab for attaching other elements of the building construction system.

To create an even surface along an uneven concrete slab edge, an elongated track (also known as a bypass clip track) is placed and secured over the slab edge. The elongated track has a track web from which two flanges (a bottom and top flange) extend perpendicularly, and a stud attachment plate, which extends perpendicularly from the track web. The first flange of the track is secured to the bent plate (adjacent the bottom of the slab) via an attachment member such as a nail, screw, pin, bolt, or the like. The second flange of the elongated track is secured to the screw pocket bracket and foam insert embedded within the concrete slab.

The stud attachment plate of the elongated track extends perpendicularly from the web, and is capable securing studs along the elongated track by attachment members such as screws, nails, pins, bolts, or the like. Since the web of the elongated track has an even surface (as opposed to an uneven slab edge surface) the use of the stud attachment plate on the even surfaced track allows the installer to place studs evenly along an uneven slab edge, since the slab edge is overlaid by the even surfaced elongated track. The elongated track can be placed and secured at various distances from the slab edge to accommodate the uneven front edge of the slab, leading to the formation of adjustment gap spaces between the elongated track and the slab edge.

In another embodiment of the present invention, the building construction system has a screw pocket bracket, elongated track, and an elongated track attachment member capable of securing the elongated track to the screw pocket bracket. The screw pocket bracket has a web from which two screw pocket flanges extend perpendicularly, a screw pocket internal channel formed between the screw pocket web and the two screw pocket flanges, and a plurality of foam inserts disposed within the internal channel of the screw pocket bracket.

In this embodiment, the elongated track has a track web from which track flanges extend perpendicularly, and a stud attachment plate extending from the track web. The stud attachment plate is capable of securing a stud to the elongated track by a stud attachment member. The elongated track attachment member is capable of securing the elongated track to the flanges of the screw pocket bracket and foam insert. Here, the elongate bracket is secured to both a top foam insert and a bottom foam insert that are disposed within the internal channel of the screw pocket bracket.

In another embodiment, the elongated track has a track web having an even surface. A first web flange and second web flange extend perpendicularly from the track web, the flanges being perpendicular to each other. A third and fourth flange extend from the first and second web flange, respectively, and are coplanar with each other. A stud attachment plate extends substantially perpendicularly from the track web.

In other embodiment of the system, different embodiments of more than one track, elongated web, stud attachment plate, and flanges can be combined and variably adjusted in order to connect multiple studs along an uneven surface.

While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

BRIEF DESCRIPTION OF THE DRAWINGS

The above and various other objects and advantages of the invention will be described and understood from the following detailed description of the preferred embodiment of the invention, the same being illustrated in the accompanying drawings.

DETAILED DESCRIPTION OF THE PREFERRED EMBODIMENT

Figure 1:
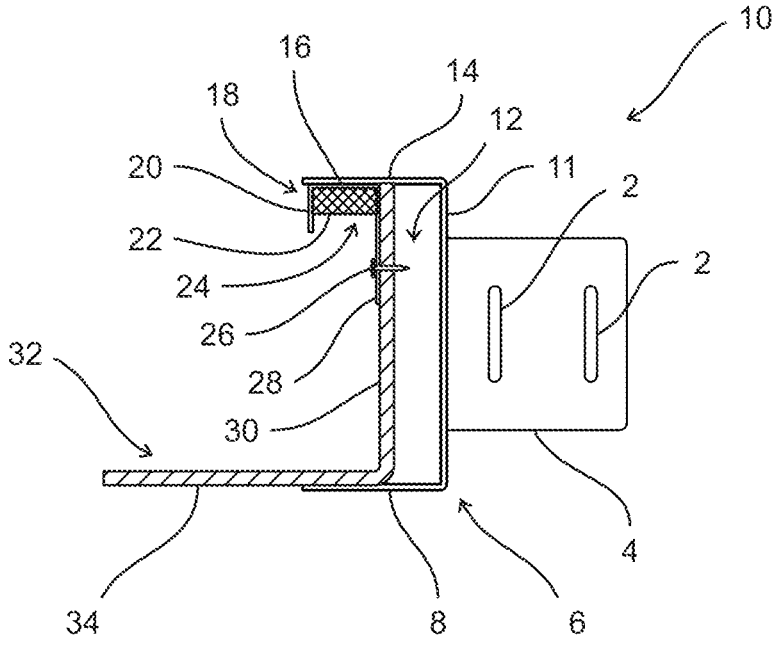
FIG. 1 is a side view of a building construction system with a foam insert.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

As used herein, the singular forms "a," "an," and "the," are intended to include the plural forms as well, unless the context clearly indicates otherwise. It will be further understood that the terms "comprises" and/or "comprising," "includes" and/or "including," and "have" and/or "having," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," and "upper" or "top," and "inner" or "outer," may be used herein to describe one element's relationship to another elements as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

Figure 2:
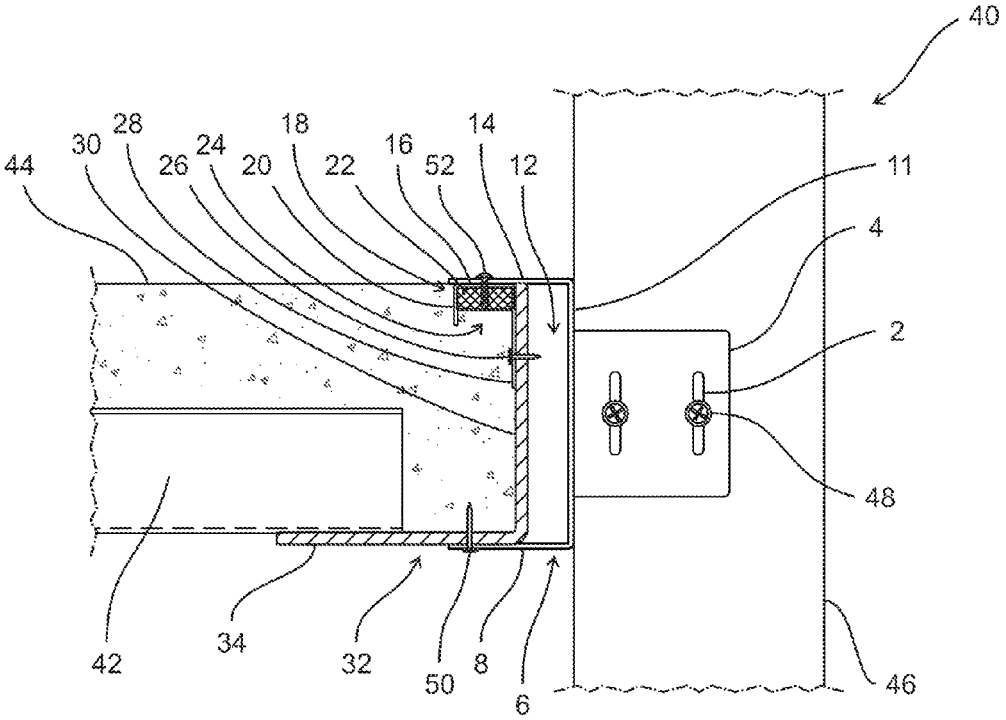
FIG. 2 is a side view of the building construction system of FIG. 1 when assembled with a concrete filled deck and stud.

Referring to FIGS. 1 and 2, there is illustrated a building construction system for adjustably connecting a wall stud to a concrete slab. The system 10 allows the installer to create an even surface to attach studs 46, even when the slab edge itself may have an uneven edge. FIG. 1 illustrates the system 10, and FIG. 2 illustrates the assembled device 40 with a concrete filled deck and wall stud 46.

The system 10 comprises a bent plate (or a pour stop) 32, a screw pocket bracket 18 that has a foam insert 22, and an elongated track (or bypass clip track) 6. The elongated track 6 can be adjustably positioned away from the bent plate 32, which creates an adjustment gap 12. The screw pocket bracket 28 is secured to the bent plate 32. After the concrete is poured into the metal deck 42, the concrete fills to the top of the bent plate 32 and screw pocket bracket 18, which has a foam insert 22. The foam insert 22 is critical in preventing concrete from filling the pocket because if concrete fills the pocket and attachment devices are secured to the concrete near the top edge of the slab, the top edge of the slab may break or spall. Instead, the foam insert 22 provides a non-concrete region to attach the elongated track 6 to the slab edge.

In a preferred embodiment, the foam insert 22 has a depth of approximately one-half inch. The foam insert 22 allows an attachment device 52, such as a pin, screw, nail, bolt, or the like, to drive through the track flanges 8, 14 and screw pocket bracket 18 into the foam insert 22. However, the attachment device 52 that secures the top flange 14 of the elongated track 6 does not penetrate the concrete the slab 44, rather it penetrates the track flanges 8, 14 and the foam insert 22. The engagement of the attachment device 52 with the track flanges 8, 14 prevents lateral movement, which is the primary purpose of any attachment of the wall studs to the slab edge. Vertical movement is not an issue under these conditions. This is advantageous because driving an attachment device 52 through concrete may break the edge of the concrete or cause spalling. Multiple foam inserts 22 may be spaced intermittently near the top front edge of slab 44 to create multiple locations where an elongated track 6 can be secured to the slab 44.

The bent plate 32 must be strong enough to support walls or other structures that are attached to the bent plate either directly or indirectly. The bent plate 32 has a first region 34 substantially perpendicular to a second region 30, thereby forming an L-shaped bent plate 34. The bent plate 32 is designed to be a pour stop that forms the bottom corner barrier and front slab barrier of the formwork. The bent plate 32 is connected to underlying primary structures, such as a spandrel beam, to carry the loads attached to the slab 44.

The screw pocket bracket 18 is secured to the bent plate 32 by any conventional attachment device 26 such as a pin, screw, nail, bolt, or the like. In the embodiment shown in FIGS. 1 and 2, the screw pocket bracket 18 is J-shaped, having a screw pocket plate 28, a screw pocket flange 16 extending substantially perpendicular from the first screw pocket plate 28, and lip 20 extending substantially perpendicular from the flange 16. The geometry of the screw pocket bracket 18 forms a pocket or internal channel having walls defined by the plate 28, flange 16, and lip 20. This internal channel 24 can be filled with a variety materials, and in the present embodiment, the internal channel 24 is filled with colloidal material, such as a foam insert 22. The foam insert 22 prevents concrete from filling in the entirety of the internal channel 24 when concrete is poured into the formwork, such as a metal deck 42. The assembled system with poured concrete and stud attachment is illustrated in FIG. 2, which shows the concrete of the slab 44 having a top surface, but the concrete does not fill in the top right portion of the slab, since the foam insert 22 prevents concrete from filling the entirety of the pocket, and instead leaves an embedded foam insert 22 within the slab 44.

Façades and walls are generally not secured directly to a concrete slab, but rather are indirectly attached to the slab 44 by steel framing attached to the slab 44. To accomplish this indirect attachment, an elongated track 6 is attached to the bent plate 32, which forms part of the front edge barrier and bottom barrier of the slab 44. To create the structure for the present invention, the screw pocket bracket 18 is first attached to the bent plate 32, then concrete is poured into the form. After the cement hardens, then the screw pocket bracket 18 and foam insert 22 embedded within the slab 44 are used as attachment regions to attached the elongated track 6 to the bent plate 32 and screw pocket bracket 18 by a first attachment member 50 on the bottom, which penetrates the bottom flange 8. A second attachment member 52 penetrates the top flange 14 and foam insert 22 to secure top elongated track 6 to the structures embedded within the hardened concrete slab 44. The geometry of the screw pocket bracket 18 can be varied so long as the geometry is able to define an internal channel 24.

The elongated track 6 has a web 11, a top flange 8 and a bottom flange 14. The flanges 8, 14 are substantially perpendicular from the web 11. The web 11 has a substantially even surface, from which protrude one or more stud attachment plates 4 that form the bracing surface for studs 46, and are capable of securing a stud 46 to the elongated track 6 via attachment members 2.

Figure 3:
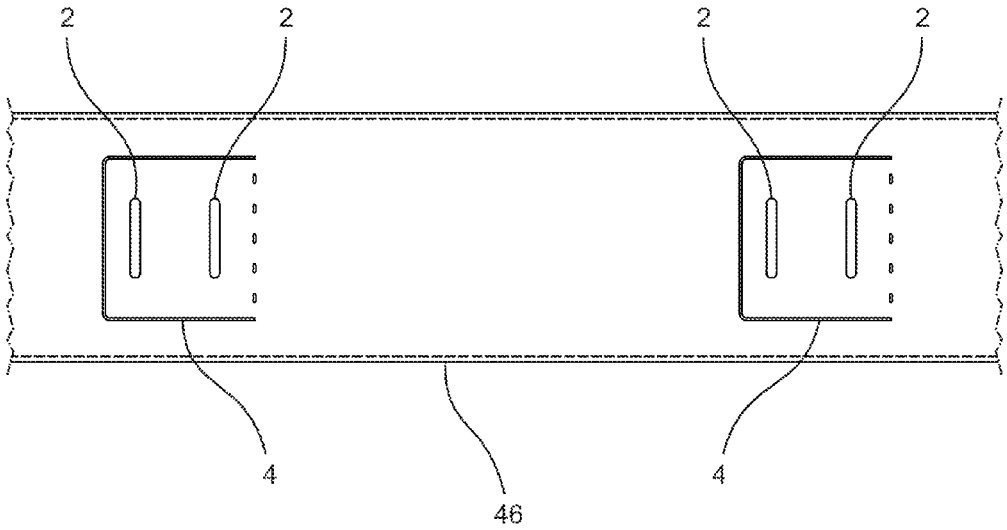
FIG. 3 is a top view of an elongated track in its preassembled form, where the stud attachment plates are flush with the web of the elongated track.

The elongated track 6 is illustrated in its preassembled form in FIG. 3. During shipping and/or fabrication the stud attachment plates 4 are flush with the web 11. To assembly the track 6 such that the stud attachment plate 4 can secure a stud 46, the stud attachment plates 4 are bent perpendicularly from the surface of the web 11. This bending of the stud attachment plates 4 may be performed by the installer, who may use a specialized grasping device that inserts over the open edges of the attachment plate 4 and rotationally pulls the attachment plate 4 into its perpendicular orientation with respect to the web 11 of the elongated track 6 (as depicted in FIGS. 1 and 2).

In the embodiment of the elongated track 6 shown, the stud attachment plate 4 has two adjustment slots 2, where an attachment member 48 such as a screw, nail, bolt, or the like, passes through and secures the stud 46 to the track 6. In a preferred embodiment, each slot is approximately 0.25 inches in width by 2 inches in length. The slotted stud attachment plate 4 allows for vertical adjustability of the studs 46 along the track 6. Several studs 46 can be placed along a single track 6, and in a preferred embodiment, each stud 46 is positioned approximately between from one foot to four feet from the next stud.

Figure 4:
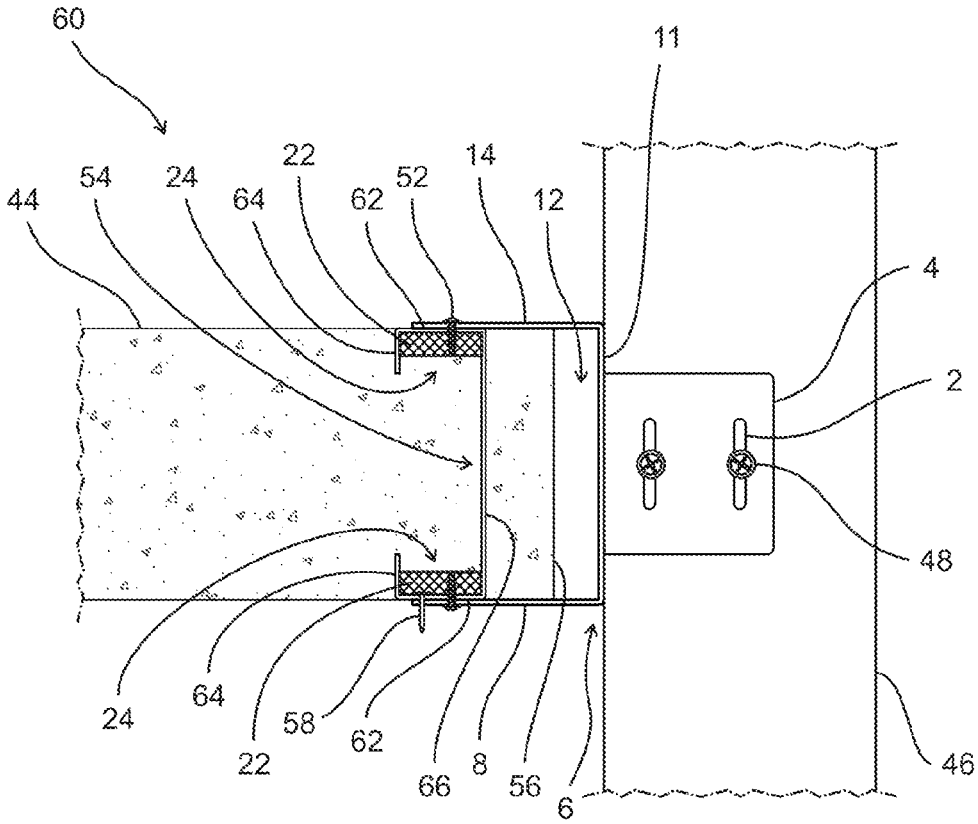
FIG. 4 is a side view of a building construction system having dual foam inserts for attachment of an elongated track when assembled with a concrete filled deck and stud.

FIG. 4 illustrates another embodiment 60 of the present invention. Here, foam inserts 22 are embedded within the top and bottom of the slab 44 which create a top and bottom attachment regions for the elongated track 6. In this embodiment, the screw pocket bracket 54 has a web 66 and two flanges 62 that extend perpendicularly from the web 66. Extending from each flange 62 is a lip 64, which forms an internal channel 24. On the top and bottom of the internal channel 24 are pockets 24 for placement of foam inserts 22. Here, the web 66 of the track 6 is fully embedded within the slab 44. To embed the web 66 and the screw pocket bracket 54, these structures are attached to the formwork framing (such as wood beams) via an attachment member 58, such as a pin, screw, bolt, nail, or the like that secures the screw pocket bracket 54 before concrete is poured.

In this embodiment, unlike the embodiment depicted in FIGS. 1 and 2, the web 66 of the screw pocket bracket 54 is fully embedded within the slab 44, and the slab edge front 56 extends beyond the web 66. The structure of the elongated track 6 may be the same as the elongated track 6 previously described in the descriptions of the elongated track 6 in FIGS. 1 and 2 above. Here, the elongated track 6 sandwiches the slab 44, and the top and bottom flanges 8, 14 are secured to both the top and bottom of the slab edge via attachment members 52. The attachment members 52 penetrate the elongated track flanges 8, 14, the screw pocket bracket flanges 62, and the foam inserts 22, but not any concrete. This embodiment has the advantage of two regions of attachment for the elongated track where the attachment members 52 do not penetrate any concrete, but only foam inserts 22. The advantage of using foam inserts 22 instead of concrete as the attachment region for the elongated track 6 is that that breakage and spalling of the slab edge is reduced.

Figure 5:
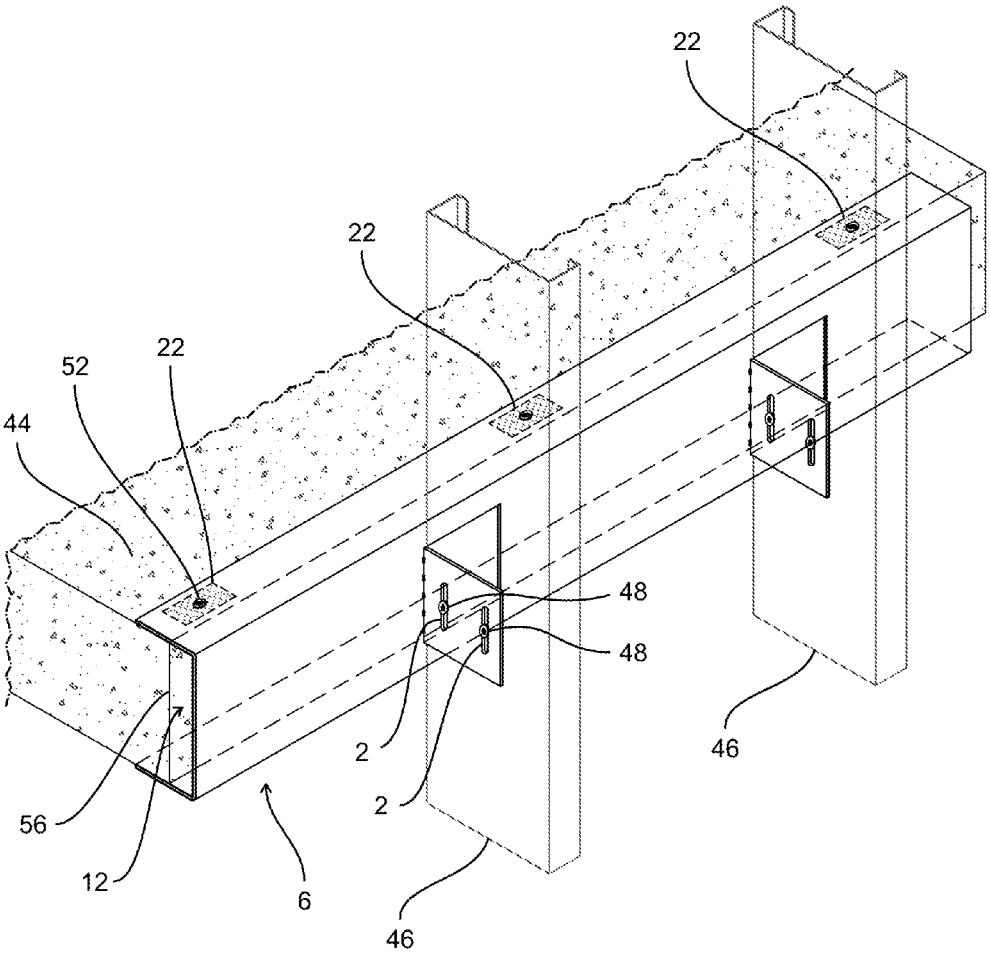
FIG. 5 is a perspective view of the embodiment of FIG. 4.

FIG. 5 depicts a perspective view of the embodiment illustrated in FIG. 4. As shown, a plurality of foam inserts 22 are interspersed on the top of the slab 44. The web and screw pocket bracket 54, which are illustrated in FIG. 4, are embedded within the slab 44 and therefore not viewable in the perspective view shown in FIG. 5. A plurality of studs 46 are aligned along the elongated track 6, which have even surfaces, in contrast the slab edge 66, which may be uneven due to the uneven placement of the formwork used to create the boundaries of the slab 44. The embodiments presented have the advantageous features of reducing the occurrence of breakage of the of the slab edge by having foam inserts 22, as well as an elongated track 6 that creates an even surfaced overlay structure that covers an uneven slab edge 66 for placement of studs, façades, and walls.

Figure 6:
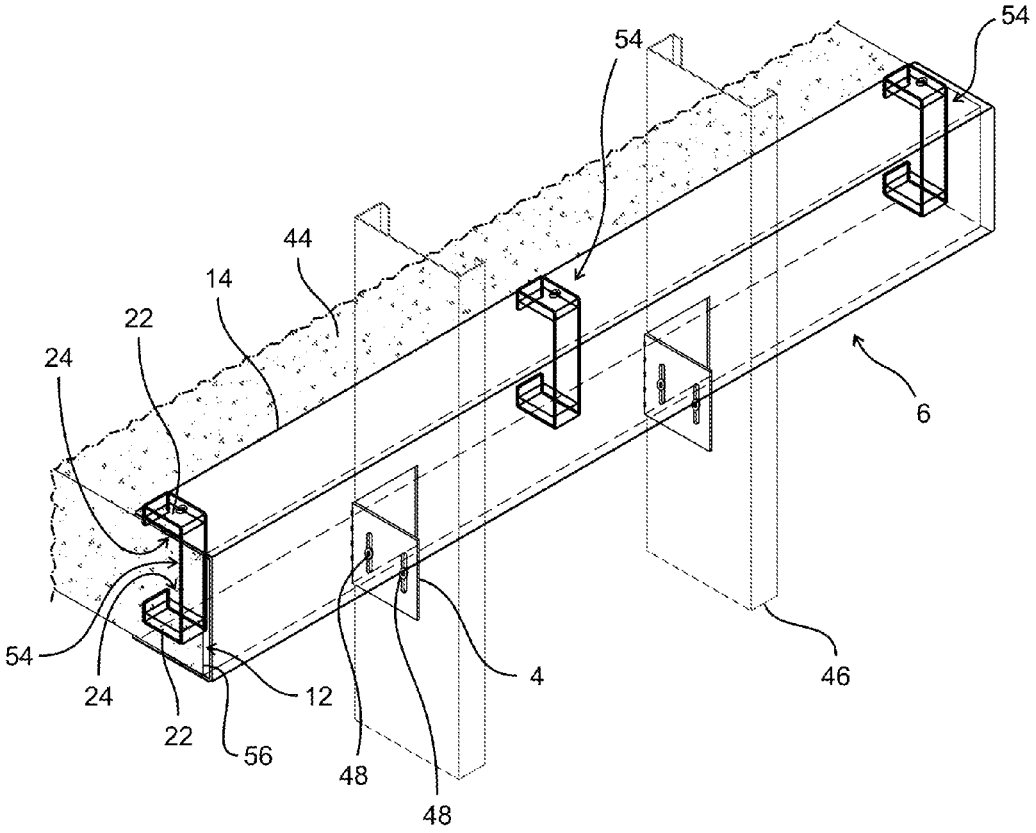
FIG. 6 is a perspective view of another embodiment of a building construction system having dual foam inserts for attachment of an elongated track when assembled with a concrete filled deck and stud.

FIG. 6 depicts another perspective view of the embodiment illustrated in FIG. 5, which shows the inside concrete slab 44. Here, the screw pocket bracket 54 is shown as being embedded within the concrete slab 44.

Figure 7:
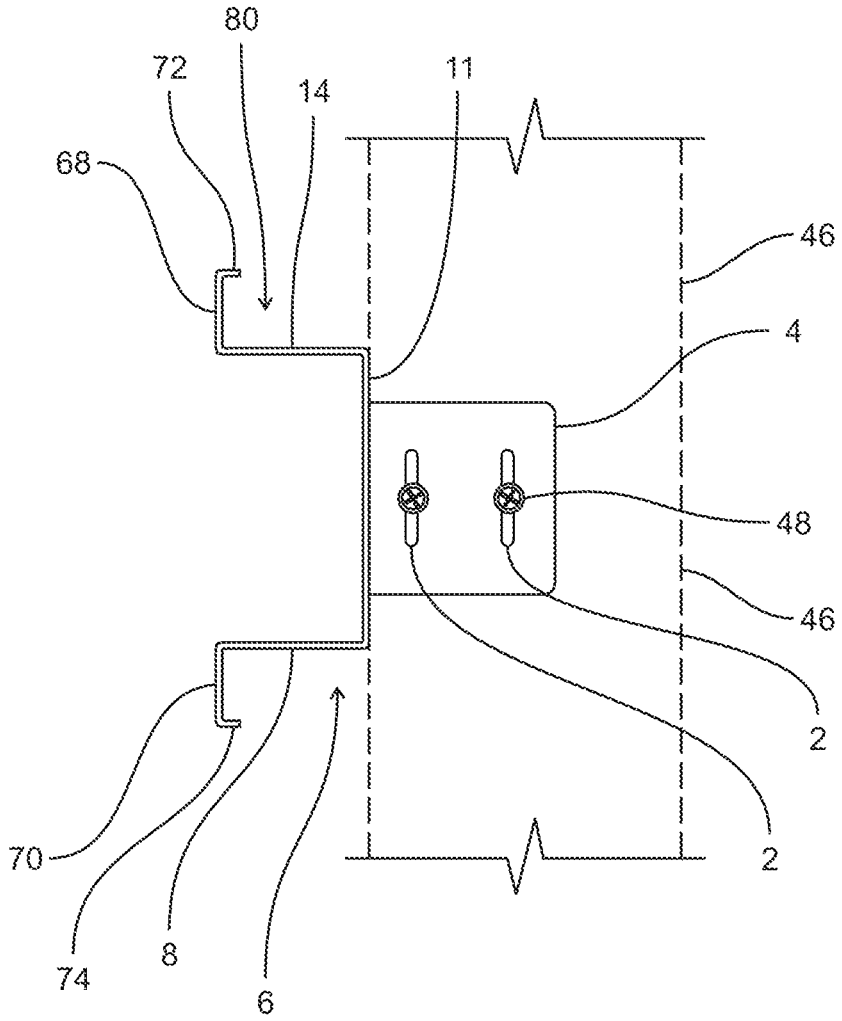
FIG. 7 is a side view of another embodiment of an elongated track and stud.
Figure 8:
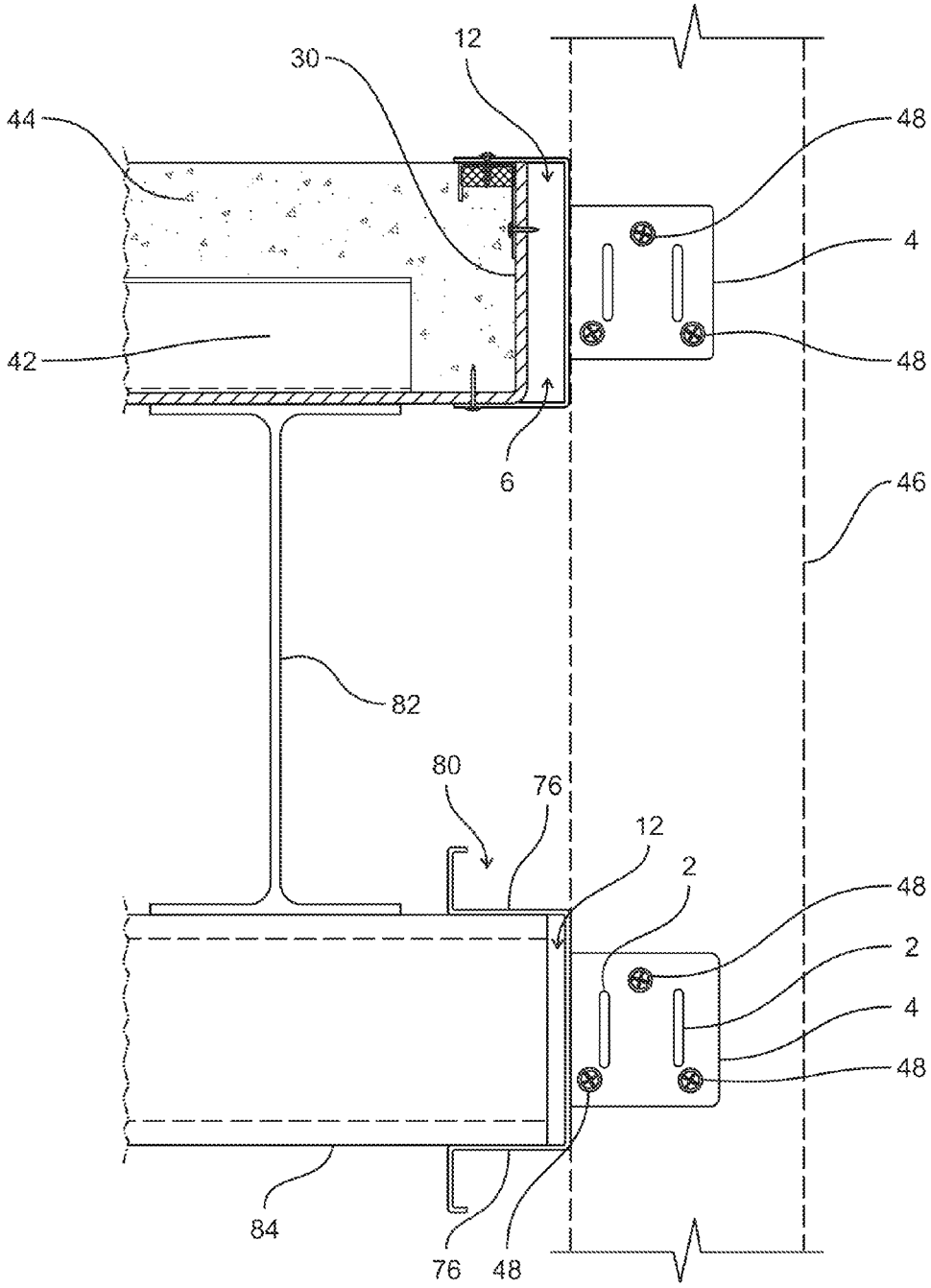
FIG. 8 is a side view of a building construction system having two elongated tracks for attaching a stud between two levels of a building.
Figure 9:
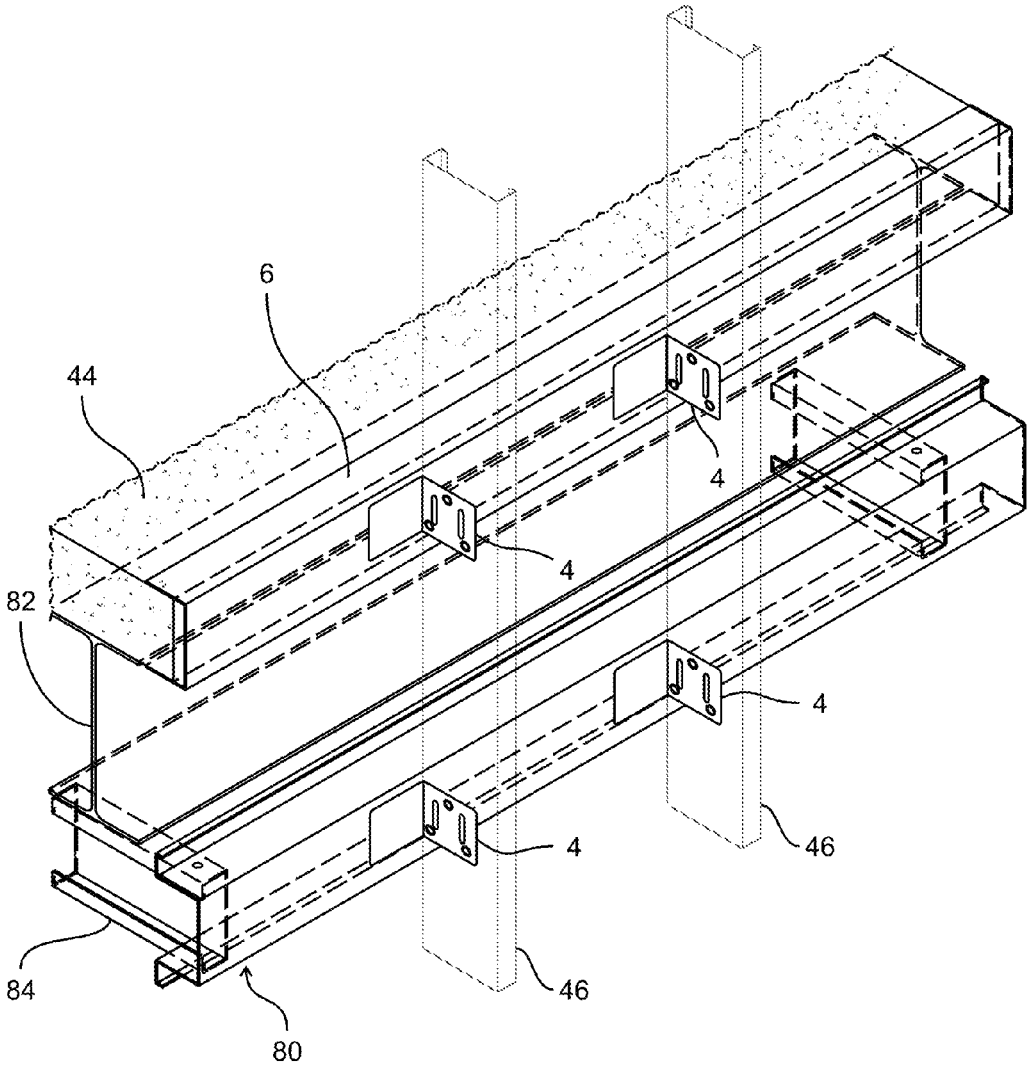
FIG. 9 is a perspective view of a building construction system having two elongated tracks and studs for attachment.

FIG. 7 depicts another embodiment of an elongated track 6 for attaching studs to a deck or slab and FIGS. 8 and 9 shows illustrate embodiment in combination with the previously described embodiments when the embodiments are attached to more than one slab. Shown here, the slab 44 and deck 84 are on different levels of a building structure. Connecting the two levels is an I-beam 82. One problem with attaching studs to slab and decks on different levels is that the front edges of the slab 44 and deck 84 may not always be in vertical alignment. If a stud 46 were attached directly to the slab 44 and deck 84, the stud 46 would be angled and not perfectly plum (i.e. vertical). To accommodate the uneven front edges of the slab 44 and deck 84, adjustment structures are placed on each. In one adjustment structure, the first elongated track on top 6 can be spaced from the front edge of the slab 44 at a predetermined distance such that when the second elongated track 80 is attached to the deck 84, the stud attachment plates 4 on both elongated tracks 6, 80 are vertically aligned. Since the elongated tracks 6, 80 are set at different distances from the slab 44 and deck 84, the adjustment gaps 12 between the slab 44 and deck 84 will vary. Attachment member 48 may be placed in the slots 2 (such as shown in FIG. 7), if the user wants to secure a stud 46 that can be adjusted up or down after the stud 46 has been attached, or, if the user prefers to firmly secure the stud 46 in one non variable position (as might be the case when the stud ends at a window), then the attachment members 48 can pierce the stud attachment plate 4 in non-slotted regions. FIG. 8 depicts three attachment members 48 per stud attachment plate 4, but any number of attachment members 48 can be used.

The second elongated track member (illustrated in FIG. 7 and the lower region of FIG. 8 and FIG. 9) has a track web 11, and first and second elongated track web flanges 8, 14 extending substantially perpendicularly from the track web flange 11. These flanges 8, 14 can be attached via deck attachment members 76 to secure the second elongated track 80 to the deck 84 or other building structure. Extending substantially perpendicularly from first and second track web flanges 8, 14 are third and fourth flanges 68, 70. The structural stability of the second elongated track 6 is increased when first and second lips 72, 74 extend from the third and fourth flanges 68, 70, respectively. In a preferred embodiment, the width of the track web 11 may be variable and the distance between stud attachment plates 4 along a single elongated track web 11 is between one inch and four feet. The width of the first and second elongated track web flanges 8, 14 are approximately two and a half inches. The widths of each of the third and fourth flanges 68, 70 are approximately one and a quarter inches and the width of the first and second lip 72, 74 is approximately three-eighths of an inch. As seen in perspective view in FIG. 9, the stud attachment plates 4 on both the first and second elongated track members 6, 80 are bent out from a cut portion on the track web, substantially square in shape and each stud attachment plate 4 forms a plane substantially perpendicular by the plane formed by the track web 11. The second elongated track 80 may be attached to several types of structures known in the art and is illustrated as attached U-shaped beams.

Figure 10:
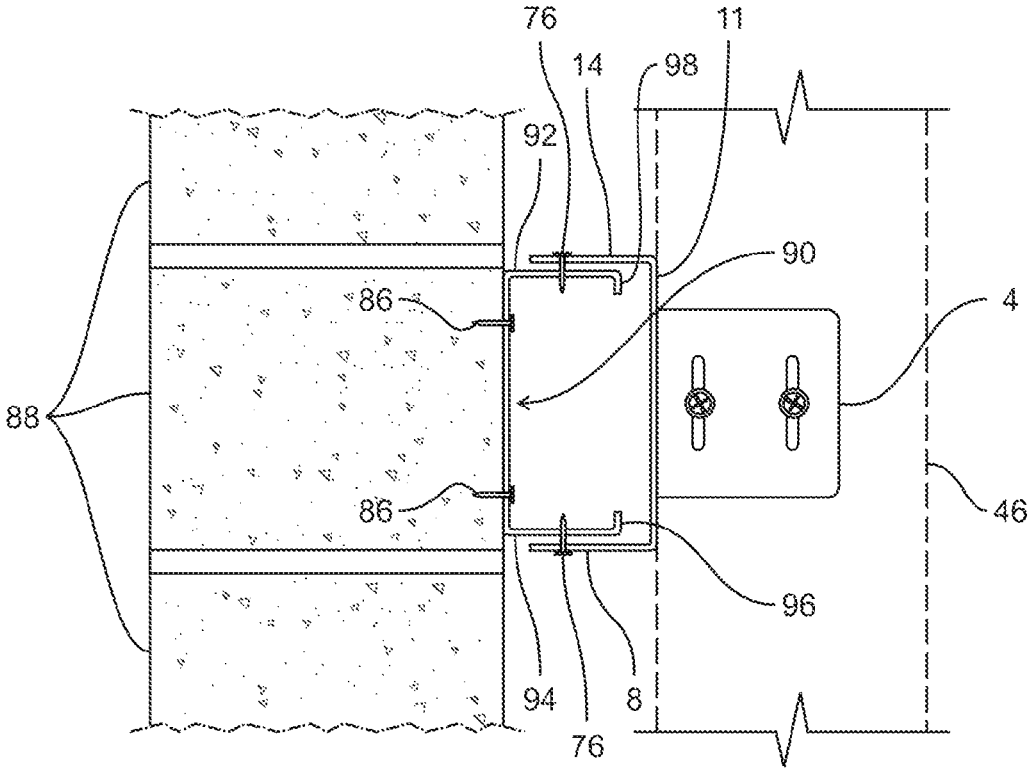
FIG. 10 is a side view of a building construction system having a stud backing, elongated track, and stud for adjustably attaching the system directly to a concrete masonry unit.
Figure 11:
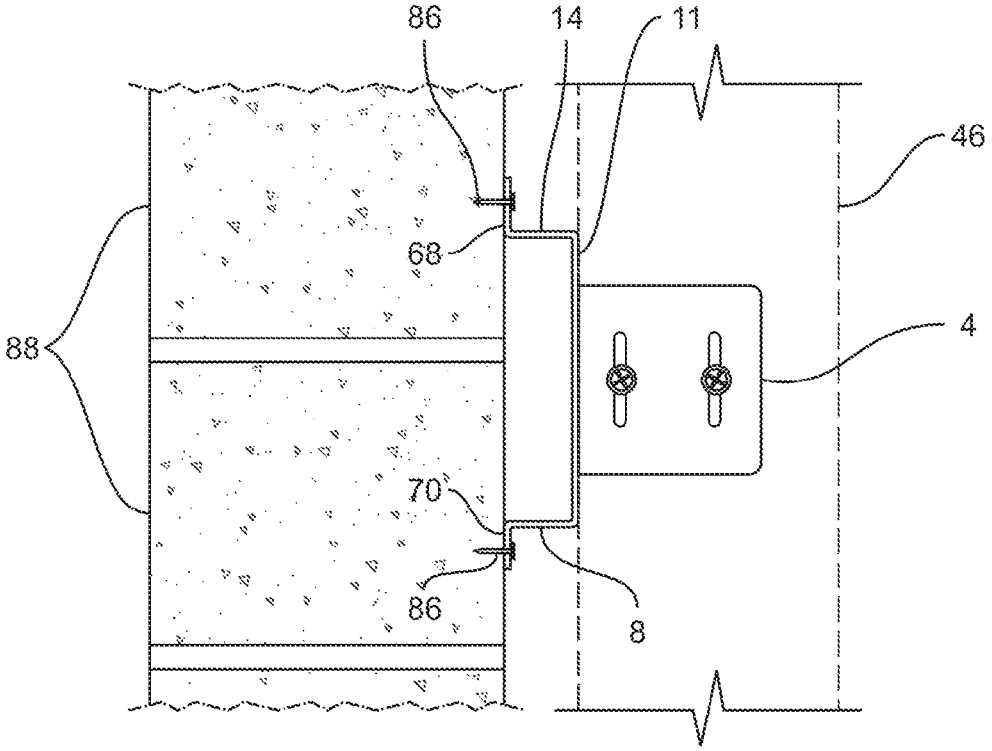
FIG. 11 is a side view of a low profile building construction system for attaching studs to a concrete masonry unit using a low profile elongated track and stud.

FIGS. 10 and 11 illustrates side views of embodiments of a building construction system useful for attaching studs to a concrete wall or concrete masonry unit. FIG. 10 illustrates a system having an adjustable connection. The system of FIG. 10 includes a stud backing member 90 attached to a concrete wall 88 with stud backing attachment members 86. The stud backing member 90 has a first flange 92 and a second flange 94, each extending substantially perpendicularly from the web 91 of the stud backing member 90. The stud backing member 90 may also include a first lip 98 extending substantially perpendicularly from the first flange 92, and a second lip 96 extending substantially perpendicularly from the second flange 94. The elongated track 6 can be attached to the stud backing member 90 at various adjustable distances from the wall 88 by varying the extent of overlap between the flanges 8, 14 on the elongated track 6 and the flanges 92, 94 on the stud backing member 90. The less overlap between the flanges, 8, 14, 92, 94, the farther out the elongated track is from the wall 88. This type of embodiment is useful for being able to attach studs to the outside or inside of a building that does not have exposed slab edges. However, attaching studs directly to a concrete or cinder block wall would be disadvantageous because various portions of the wall may not be completely in line with each other. The advantage of this embodiment is that by attaching one or more of the stud backing members 90 and elongated track 6 to the concrete wall, and adjustable varying the extent of overlap between the stud backing member 90 and elongated track 6, studs 46 can be secured to a wall and be made completely straight and plumb. This embodiment eliminates the use of shims to make structures straight and plumb before other structures are placed on the studs.

In the embodiment illustrated in FIG. 11, a low profile elongated track 80 is used to attach studs 46 to a wall 88. The low profile elongated track 80 has the same features as the elongated track 80 previously illustrated in FIG. 7, but here is shown without the lipped structures 72, 74 shown in the embodiment of FIG. 7. In this embodiment, the third and fourth flanges 68, 70 are attached directly to the concrete wall 88 via attachment members 86 that pierce the flanges 68, 70 and penetrate the concrete. The width of the first and second flanges 8, 14 create the distance between the wall 88 and the web 11 of the elongated track 80. The shorter the width of the first and second flanges 8, 14, the lower the profile of the elongated track and the close the studs 46 can be placed to the wall 88. This embodiment is advantageous if the user prefers to place studs near the wall, but does not want to use a stud backing member that would the distance between the stud 46 and the wall 88.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

I claim:

1. A building construction system for forming a even surfaced structure along an uneven slab edge, the building construction system comprising:

a) a bent plate having a first region substantially perpendicular to a second region;

b) a screw pocket bracket secured to said bent plate via a screw pocket bracket attachment member, the screw pocket bracket having, i) a screw pocket plate, ii) a screw pocket flange substantially perpendicular to said screw pocket plate, and iii) a screw pocket lip extending substantially perpendicular from said screw pocket flange, wherein said screw pocket plate, said screw pocket flange, and said screw pocket lip form the outer boundaries of a screw pocket internal channel, iv) a foam insert disposed within said screw pocket internal channel;

c) an elongated track having, i) a track web having an even surface from which track flanges extend perpendicularly; and, ii) a stud attachment plate extending from said track web, wherein said stud attachment plate is capable of securing a stud to said elongated track via a stud attachment member;

whereby overlaying said elongated track allows an installer to overlay an even surfaced structure over an uneven slab edge and reduces breakage of a slab edge by attaching said elongated track to said foam insert.

2. The building construction system of claim 1, wherein said screw pocket bracket is J-shaped.

3. The building construction system of claim 1, wherein said screw pocket bracket plate is secured to said second region of said bent plate.

4. The building construction system of claim 1, wherein said elongated track further comprises a plurality of stud attachment plates.

5. The building construction device of claim 1, wherein said stud attachment plate comprises at least one slot within said stud attachment plate for insertion of said stud attachment member.

6. The building construction device of claim 1, wherein said foam insert is approximately one-half inch (1.27 cm) in depth.

* * * * *